US005860313A

United States Patent [19]

Nagai et al.

[11] Patent Number: 5,860,313

[45] Date of Patent: Jan. 19, 1999

[54] METHOD OF MANUFACTURING PRESS-FORMED PRODUCT

[75] Inventors: Yoshitaka Nagai, Asahi-machi; Katsuyuki Taketani, Kurobe, both of Japan

[73] Assignee: YKK Corporation, Tokyo, Japan

[21] Appl. No.: 768,918

[22] Filed: Dec. 18, 1996

[30] Foreign Application Priority Data

Dec. 27, 1995 [JP] Japan ..... 7-341222

[51] Int. Cl.[6] ..... B21J 1/06

[52] U.S. Cl. ..... 72/364; 72/709; 148/564

[58] Field of Search ..... 72/359, 709, 364; 148/564, 691

[56] References Cited

U.S. PATENT DOCUMENTS

| | | | |
|---|---|---|---|
| 1,410,093 | 3/1922 | Dallmeyer et al. | 72/359 |
| 5,332,456 | 7/1994 | Masumoto et al. | 148/564 |
| 5,415,709 | 5/1995 | Kita | 148/691 |

FOREIGN PATENT DOCUMENTS

| | | | |
|---|---|---|---|
| 151026 | 9/1920 | United Kingdom | 72/359 |
| 1456050 | 11/1976 | United Kingdom | 72/709 |

*Primary Examiner*—Lowell A. Larson

*Attorney, Agent, or Firm*—Finnegan, Henderson, Farabow, Garrett & Dunner, L.L.P.

[57] ABSTRACT

A method of manufacturing a press-formed product having a base portion and a projecting portion which is integral with the base portion and projects in a direction different from the base portion, wherein a first forming part for forming the base portion and a second forming part which is integral with the first forming part and projects in a direction different from the first forming part are provided in a divided forming mold, and the first forming part communicates with an accommodating hole having an alloy material input port which is smaller in area than the first forming part, the method comprising the steps of moving a material placed in the accommodating hole, in the state of plastic flow by means of pressure means, and moving the material in the state of plastic flow while sequentially changing the direction of movement of the material, from the accommodating hole to the first forming part and then from the first forming part to the second forming part, thereby press-feeding and forming the alloy material while applying a strain thereto.

6 Claims, 3 Drawing Sheets

METHOD OF MANUFACTURING PRESS-FORMED PRODUCT

BACKGROUND OF THE INVENTION

1. Field of the Invention

The present invention relates to a method of manufacturing from a plastic material or a superplastic metal material a press-formed product, for example, a formed product of complicated shape such as a golf club head or an automobile component, specifically, a formed product which is shaped to have a base portion and a projecting portion in a direction different from the base portion.

2. Description of the Prior Art

Forging has heretofore been known as a method of forming a complicated shape employing a metal material. Forging is a method of compressing a material to destroy its cast structure and compress its harmful defects, thereby improving the mechanical properties of the material and producing a product of desired shape. Forging is used in various applications.

However, if a formed product is to be produced by forging, a preform which is conformed to the shape of the formed product in advance is needed. As the shape of a product becomes more complicated, the shape must be modified gradually in more forging steps, so that multistage production is needed. Particularly if a rapidly-solidified alloy material is employed as a material for the formed product, the superior characteristics of the rapidly-solidified alloy material are easily affected by heat during the formation of the aforesaid preform and multistage formation, with the result that crystal grains become coarse and the superior features of the rapidly-solidified alloy material are impaired.

SUMMARY OF THE INVENTION

An object of the present invention is to provide a press-formed-product manufacturing method which can readily produce even a formed product of complicated shape without the need to perform formation of a preform or multistage formation, and a press-formed-product manufacturing method which can employ a rapidly-solidified metal material without easily causing a lowering in its characteristics.

The present invention provides a forming method of a combined type which includes a conventional extrusion method and a compression molding method. Specifically, in a method of manufacturing a press-formed product having a base portion and a projecting portion which is integral with the base portion and projects in a direction different from the base portion, a first forming part for forming the base portion and a second forming part which is integral with the first forming part and projects in a direction different from the first forming part are provided in a divided forming mold, and the first forming part communicates with an accommodating hole having an alloy material input port which is smaller in area than the first forming part. The method comprises the steps of moving a material placed in the accommodating hole, in the state of plastic flow by means of pressure means, and moving the material in the state of plastic flow while sequentially changing the direction of movement of the material, from the accommodating hole to the first forming part and then from the first forming part to the second forming part, thereby press-feeding and forming the alloy material while applying a strain thereto.

DETAILED DESCRIPTION OF THE PREFERRED EMBODIMENTS

Figure 1:
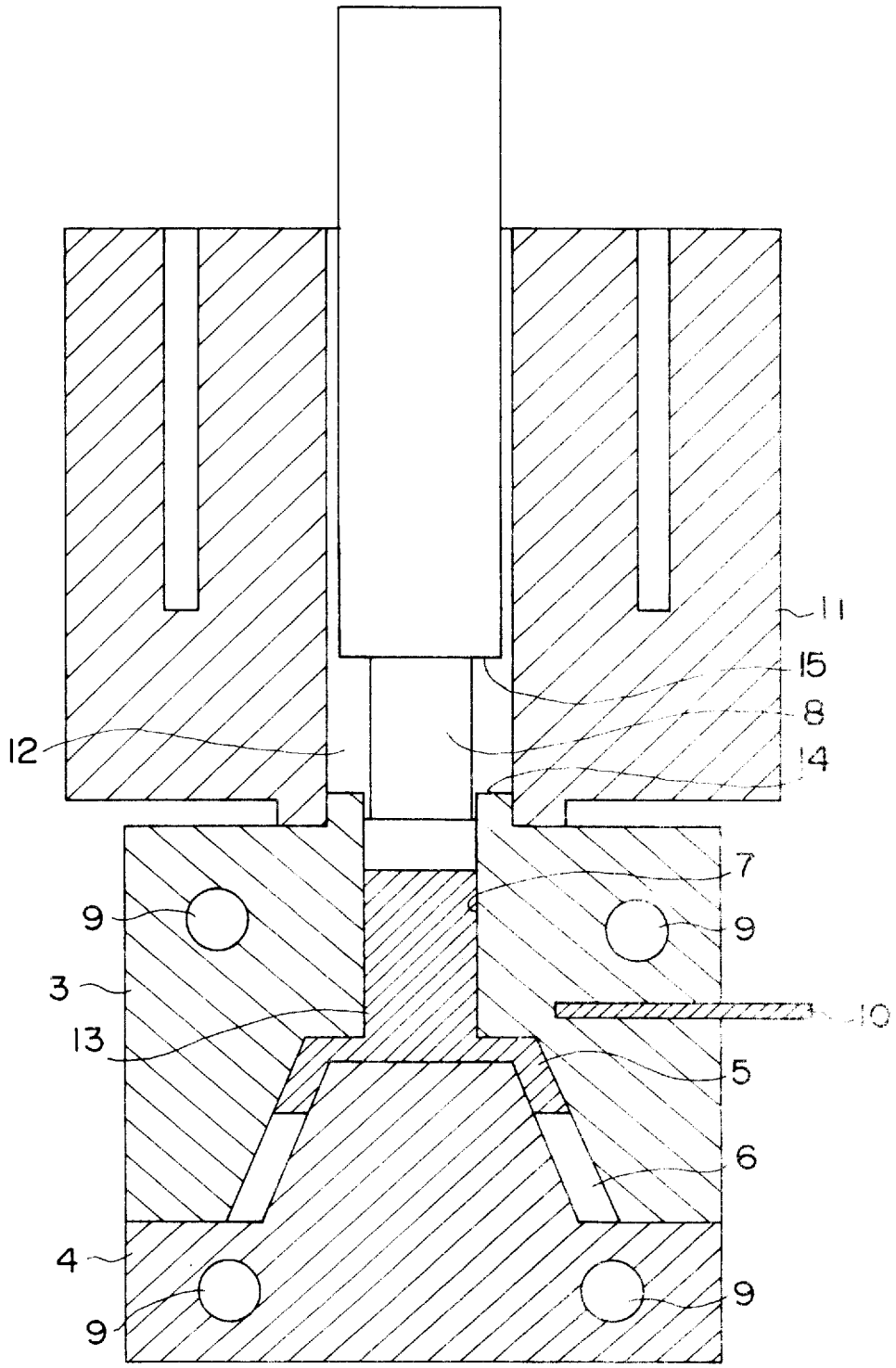
FIG. 1 is a cross-sectional view of a device in which the present invention can suitably be carried out.

In the method of the present invention, a feed alloy material is passed through the alloy material input port from a container section, and is press-fed into the first forming part for forming a base portion. Since the alloy material input port is smaller in area than the first forming part, the alloy material pressed out of the container section changes its direction immediately after passing through the alloy material input port, i.e., if the base portion to be formed extends in a perpendicular direction, the alloy material moves in the state of plastic flow in an approximately perpendicular direction from the alloy material input port toward the first forming part. In addition, since the first forming part and the second forming part differ in direction, the alloy material is made to move in the state of plastic flow in a different direction while moving from the first forming part to the second forming part. Thus, each time the direction of the plastic flow of the alloy material changes, the alloy material is given a strain. As the direction of the plastic flow changes to a greater extent, the alloy material is given a larger strain. Since the alloy material is hardened by being given such strain, improvement in its characteristics can be expected. Specifically, when the material is press-fed into a forming section, the direction of movement of the material is immediately changed to an approximately perpendicular direction, whereby a strain is given to the material and the fine crystal structure of the material undergoes a smooth grain boundary migration or sliding. Accordingly, the anisotropy of the material are eliminated, and the mechanical characteristics of the material, such as strength and elongation, are improved to a far greater extent.

The alloy material to be applied to the present invention is preferably a material which exhibits superplasticity so that the aforesaid plastic flow can be caused. Particularly if a superplastic rapidly-solidified alloy material is employed to produce a formed product in which its superior characteristics are maintained, the working of the material must be completed in a short time while taking account of thermal effects.

A specific superplastic alloy material to be applied to the present invention has a composition represented by one of the following general formulae (I) to (IV):

$$Al_aM_{1b}X_e \quad \text{(I)}$$

$$Al_aM_{1(b-c)}M_{2c}X_e \quad \text{(II)}$$

$$Al_aM_{1(b-d)}M_{3d}X_e \quad \text{(III)}$$

$$Al_aM_{1(b-c-d)}M_{2c}M_{3d}X_e \quad \text{(IV)}$$

(where $M_1$ is at least one element selected from the group consisting of Mn, Fe, Co, Ni and Mo; $M_2$: at least one element selected from the group consisting of V, Cr and W; $M_3$ is at least one element selected from the group consisting of Li, Ca, Mg, Si, Cu and Zn; X is at least one element selected from the group consisting of Nb, Hf, Ta, Y, Zr, Ti, Ag, rare-earth elements and Mm (mesh metal) which is a composite of rare-earth elements; and a, b, c, d and e are, in atomic percentages, $75 \leqq a \leqq 97$, $0.5 \leqq b \leqq 15$, $0.1 \leqq c \leqq 5$, $0.5 \leqq d \leqq 5$, and $0.5 \leqq e \leqq 10$.)

Such superplastic alloy material has preferably an average Al grain size of not greater than 1 μm and an average intermetallic-compound grain size of not greater than 1 μm, more preferably an average Al grain size of 0.005–1 μm and an average intermetallic-compound grain size of 0.001–0.1 μm.

The material stored in the container may be fed as powder or as a solid which is formed in advance.

In a preferred embodiment of the forming process according to the present invention, the material is heated to a temperature of not less than a crystallization temperature (Tx) and is formed in a temperature range of 350° C. to 600° C. within 300 seconds. The formed material is cooled at a cooling rate of not less than 50° C./s. The heating rate is 30° C./s to 300° C./s.

The reason why the heating temperature and the heating rate are determined as described above is that it is possible to prevent crystal grains from becoming coarse and retain the superior characteristics of the material.

If the material is to be formed by the method of the present invention, the strain rate is not less than $10^{-3}s^{-1}$, preferably not less than $10^{-1}s^{-1}$, and the flow stress at this time is approximately 10–50 MPa. If the strain rate is less than $10^{-3}s^{-1}$, the superplasticity of the material is not able to fully function, so that cracks or the like easily occur in the resultant formed product. If account is taken of the filling characteristics of the material, it is preferable that the flow stress be approximately 10–50 MPa.

An embodiment of the present invention will be described below with reference to the accompanying drawings.

Figure 2A:
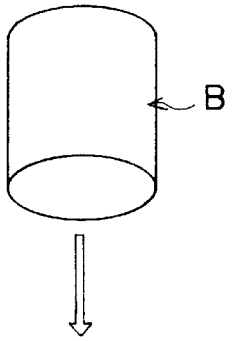
FIGS. 2A to 2C are explanatory views of a formed product.

FIG. 1 shows one example of a device in which the present invention can suitably be carried out. The device is arranged to obtain a formed product A (shown in FIG. 2B), which includes a base portion 1 and a projecting portion 2, from a billet B of an alloy material (shown in FIG. 2A). FIG. 2C is a cross-sectional view of the formed product A.

In this device, a forming section which comprises a first forming part 5 for forming the base portion 1 of the formed product A and a second forming part 6 for forming the projecting portion 2 is provided between an upper mold section 3 and a lower mold section 4 which constitute a divided mold, and an accommodating hole 7 into which to charge a material is formed in the upper mold section 3 immediately above the first forming part 5, and a stem 8 for press-feeding a material to be formed is provided in the accommodating hole 7. Each of the upper mold section 3 and the lower mold section 4 is provided with heating means 9 for heating the material and the resultant formed product, and heating temperature is regulated on the basis of a thermocouple 10.

A clamp 11 is disposed immediately above the upper mold section 3, and an inserting hole 12 which communicates with the accommodating hole 7 of the upper mold section 3 is formed in the clamp 11. The material is charged into the accommodating hole 7 through the inserting hole 12.

Figure 2B:
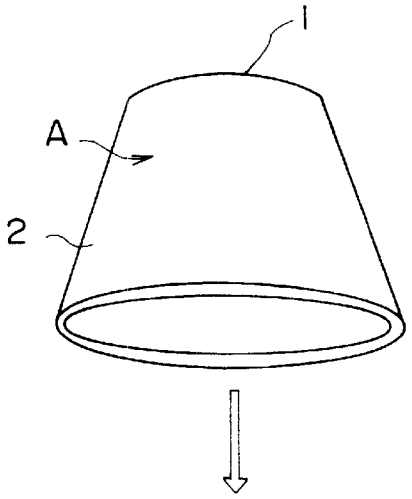
Figure 2C:
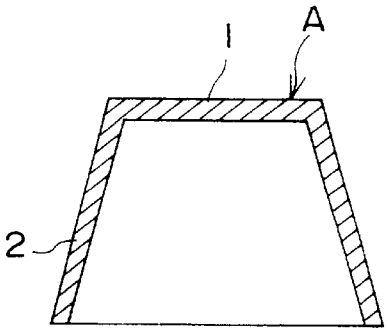

If the formed product A shown in FIG. 2B is to be produced by using the above-described device, a feed material (extrusion material) 13 is charged into the accommodating hole 7 of the upper mold section 3, and the upper mold section 3 is pressed by the clamp 11. The feed material 13 may be in the form of the billet B or powder.

The feed material 13 is heated to a predetermined temperature by the heating means 9 provided in each of the upper mold section 3 and the lower mold section 4. During this time, temperature is regulated on the basis of the thermocouple 10. After heating, the stem 8 is made to travel into the accommodating hole 7 in the upper mold section 3 through the inserting hole 12 of the clamp 11, and the feed material 13 is press-fed into the forming section through the accommodating hole 7. The feed material 13 press-fed in this manner moves in the state of plastic flow while being given a strain approximately perpendicular to the first forming part 5, and likewise moves in the state of plastic flow from the first forming part 5 to the second forming part 6 while being given a strain approximately perpendicular to the second forming part 6. The formation of the formed product A is completed when a stem restriction part 15 provided on the stem 8 comes into abutment with an upper-mold-section restriction part 14 provided on the upper mold section 3.

Through the above-described manufacturing process, the cup-shaped formed product A having the base portion 1 and the projecting portion 2 which projects in a direction different from the base portion 1 is formed as shown in FIGS. 2B and 2C.

Figure 3:
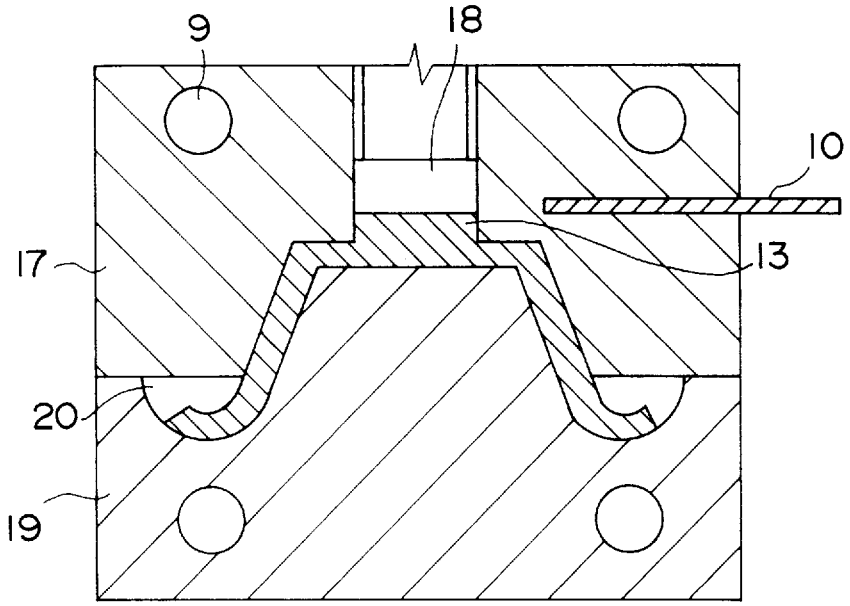
FIG. 3 is a cross-sectional view of another device in which the present invention can suitably be carried out.
Figure 4:
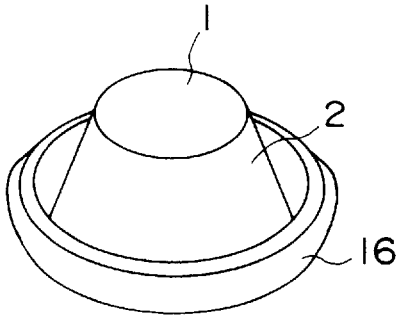
FIG. 4 is a perspective view of a formed product obtained by using the device of FIG. 3.

FIG. 3 shows an example of a device for manufacturing a formed product which has a curled portion 16 at the end of the projecting portion 2 projecting from the base portion 1, as shown in FIG. 4. An upper mold section 17 of this device has the same shape as the upper mold section 3 of FIG. 1, and a stem 18 has the same shape as the stem 8 of FIG. 1. A curved notch is formed at the end of the second forming part of a lower mold section 19 and a curl forming part 20 having an open top is provided. The feed material 13 is press-fed into the second forming part from the first forming part by the stem 18 and is curved along the curved portion of the curl forming part 20, whereby the curled portion 16 is formed at the end of the projecting portion 2.

EXAMPLES

A rapidly-solidified Al-base alloy powder composed of $Al_{93}Ni_6Mm_{0.9}Ag_{0.1}$ (at. %) was produced by means of a gas atomizing apparatus. After the produced Al-base alloy powder was charged into a metal capsule, degasification was performed, and an extruder was used to extrude the Al-base alloy powder and the composition portion of the metal capsule was removed. Thus, a billet was obtained as a feed material. This feed material was fed to the device shown in FIG. 1, and the formed product shown in FIG. 2B was produced in the procedure described above in connection with FIG. 1. Specific conditions were as follows. The heating rate by the heating means was 75° C./s and the feed material was heated to 500° C., and the heated feed material was extruded into the forming section at an extrusion rate of 10 mm/s by the stem. The process of heating the feed material and removing the formed product was completed in 60 seconds. After the formed product was removed, it was cooled at a cooling rate of 100° C./s. The strength of the billet, i.e., the feed material, was 75 kgf/mm$^2$, whereas the strength of the formed product was 70 kgf/mm$^2$. It will be understood, therefore, that the formed product had superior strength and also that a lowering in strength can be suppressed if a formed product is manufactured by the method of the present invention.

Although the formed product shown in FIG. 4 was manufactured from the aforesaid material by means of the device shown in FIG. 3, the result was similar to that of above-described example.

In accordance with the method of the present invention, neither formation of a preform nor multistage formation is needed, and even a formed product of comparatively complicated shape can readily be produced. In addition, if a rapidly-solidified alloy material is employed as a forming material, it is possible to provide a formed product having a superior mechanical nature without substantially lowering the characteristics of the rapidly-solidified alloy material itself.

What is claimed is:

1. A method of manufacturing a press-formed product having a base portion and a projecting portion which is integral with said base portion and projects in a direction different from said base portion, wherein a first forming part for forming said base portion and a second forming part which is integral with said first forming part and projects in a direction different from said first forming part are provided in a divided forming mold, and said first forming part communicates with an accommodating hole having an alloy material input port which is smaller in area than said first forming part, said method comprising the steps of rapidly heating at a heating rate of 30° C./s to 300° C./s a superplastic rapidly solidified alloy material having an average grain size of not greater than 1 $\mu$m and an average intermetallic compound grain size of not greater than 1 $\mu$m placed in said accommodating hole, moving said material in the state of plastic flow by means of pressure means, and moving said material in the state of plastic flow while sequentially changing the direction of movement of said material, from said accommodating hole to said first forming part and then from said first forming part to said second forming part, thereby press-feeding and forming said alloy material in a temperature range of 350° C. to 600° C. within 300 seconds while applying a strain thereto, the formed product being cooled at a cooling rate of not less than 50° C./s after said forming.

2. A method of manufacturing a press-formed product according to claim 1, wherein a strain rate of said forming is not less than $10^{-3}s^{-1}$ and a flow stress of said material due to press-feeding is 10–50 MPa.

3. A method of manufacturing a press-formed product according to claim 1, wherein said superplastic alloy material is represented by the following general formula:

$$Al_aM_{1b}X_e$$

wherein $M_1$ is at least one element selected from the group consisting of Mn, Fe, Co, Ni and Mo; X is at least one element selected from the group consisting of Nb, Hf, Ta, Y, Zr, Ti, Ag, rare-earth elements and Mm (mesh metal) which is a composite of rare-earth elements; and a, b, and e are, in atomic percentages, $75 \leqq a \leqq 97$, $0.5 \leqq b \leqq 15$, and $0.5 \leqq e \leqq 10$.

4. A method of manufacturing a press-formed product according to claim 1, wherein said superplastic alloy material is represented by the following general formula:

$$Al_aM_{1(b-c)}M_{2c}X_e \quad \text{(II)}$$

wherein $M_1$ is at least one element selected from the group consisting of Mn, Fe, Co, Ni and Mo; $M_2$ is at least one element selected from the group consisting of V, Cr and W; X is at least one element selected from the group consisting of Nb, Hf, Ta, Y, Zr, Ti, Ag, rare-earth elements and Mm (mesh metal) which is a composite of rare-earth elements; and a, b, c, and e are, in atomic percentages, $75 \leqq a \leqq 97$, $0.5 \leqq b \leqq 15$, $0.1 \leqq c \leqq 5$, and $0.5 \leqq e \leqq 10$.

5. A method of manufacturing a press-formed product according to claim 1, wherein said superplastic alloy material is represented by the following general formula:

$$Al_aM_{1(b-d)}M_{3d}X_e \quad \text{(III)}$$

wherein $M_1$ is at least one element selected from the group consisting of Mn, Fe, Co, Ni and Mo; $M_3$ is at least one element selected from the group consisting of Li, Ca, Mg, Si, Cu and Zn; X is at least one element selected from the group consisting of Nb, Hf, Ta, Y, Zr, Ti, Ag, rare-earth elements and Mm (mesh metal) which is a composite of rare-earth elements; and a, b, d, and e are, in atomic percentages, $75 \leqq a \leqq 97$, $0.5 \leqq b \leqq 15$, $0.5 \leqq d \leqq 5$, and $0.5 \leqq e \leqq 10$.

6. A method of manufacturing a press-formed product according to claim 1, wherein said superplastic alloy material is represented by the following general formula:

$$Al_aM_{1(b-c-d)}M_{2c}M_{3d}X_e \quad \text{(IV)}$$

wherein $M_1$ is at least one element selected from the group consisting of Mn, Fe, Co, Ni and Mo; $M_2$ is at least one element selected from the group consisting of V, Cr and W; $M_3$ is at least one element selected from the group consisting of Li, Ca, Mg, Si, Cu and Zn; X is at least one element selected from the group consisting of Nb, Hf, Ta, Y, Zr, Ti, Ag, rare-earth elements and Mm (mesh metal) which is a composite of rare-earth elements; and a, b, c, d, and e are, in atomic percentages, $75 \leqq a \leqq 97$, $0.5 \leqq b \leqq 15$, $0.1 \leqq c \leqq 5$, $0.5 \leqq d \leqq 5$, and $0.5 \leqq e \leqq 10$.

* * * * *